US011604045B2

(12) United States Patent
Emborg

(10) Patent No.: US 11,604,045 B2
(45) Date of Patent: Mar. 14, 2023

(54) SECURITY BARRIER FOR PROVIDING PROTECTION IN PUBLIC SPACE

(71) Applicant: ROCKWOOL International A/S, Hedehusene (DK)

(72) Inventor: Michaeel Emborg, Hedehusene (DK)

(73) Assignee: ROCKWOOL International A/S, Hedehusene (DK)

( * ) Notice: Subject to any disclaimer, the term of this patent is extended or adjusted under 35 U.S.C. 154(b) by 0 days.

(21) Appl. No.: 17/518,705

(22) Filed: Nov. 4, 2021

(65) Prior Publication Data

US 2022/0057176 A1 Feb. 24, 2022

Related U.S. Application Data

(63) Continuation of application No. 17/062,503, filed on Oct. 2, 2020, now Pat. No. 11,215,427, which is a continuation of application No. PCT/EP2019/058179, filed on Apr. 1, 2019.

(30) Foreign Application Priority Data

Apr. 4, 2018 (EP) ..... 18165619

(51) Int. Cl.
*F41H 5/04* (2006.01)
*F41H 5/24* (2006.01)

(52) U.S. Cl.
CPC ..... *F41H 5/0471* (2013.01); *F41H 5/0442* (2013.01); *F41H 5/24* (2013.01)

(58) Field of Classification Search
CPC ..... F41H 5/0471; F41H 5/0442; F41H 5/24
USPC ..... 89/36.02
See application file for complete search history.

(56) References Cited

U.S. PATENT DOCUMENTS 3,567,536 A * 3/1971 Wickersham, Jr. ..... B60K 15/03177 220/88.1
3,787,279 A * 1/1974 Winchester ..... B32B 1/08 220/900
3,816,234 A * 6/1974 Winfield ..... A47K 13/00 4/234
4,615,455 A * 10/1986 Tansill ..... B60K 15/03 220/88.1
6,749,076 B2 * 6/2004 Fingerhut ..... B65D 88/14 109/15
7,275,888 B1 * 10/2007 Christensen ..... E01F 15/086 404/6
7,896,182 B1 * 3/2011 Hansen ..... B65D 11/1873 220/4.31
2004/0141807 A1 * 7/2004 Yodock, Jr. ..... E01F 15/086 404/6

(Continued)

FOREIGN PATENT DOCUMENTS

WO 2013113410 A1 8/2013

*Primary Examiner* — Samir Abdosh
(74) *Attorney, Agent, or Firm* — Wei & Sleman LLP

(57) ABSTRACT

The present invention concerns a security barrier for providing protection in a public space or the like, said barrier comprising a mineral wool assembly comprising at least one mineral wool element having an outer liquid impermeable covering and wherein the at least one mineral wool element is adapted for being filled with a liquid. The invention further comprises a method of manufacturing such security barrier and a method of preparing the security barrier for providing protection in a public space.

23 Claims, 4 Drawing Sheets

(56) References Cited

U.S. PATENT DOCUMENTS

| | | | | |
|---|---|---|---|---|
| 2009/0217812 | A1* | 9/2009 | Whitaker | C25D 15/02<br>89/36.02 |
| 2017/0175349 | A1* | 6/2017 | Davis | E01F 15/086 |

* cited by examiner

SECURITY BARRIER FOR PROVIDING PROTECTION IN PUBLIC SPACE

CROSS-REFERENCE TO RELATED APPLICATIONS

The present application is a continuation of U.S. patent application Ser. No. 17/062,503, filed Oct. 2, 2021, entitled "A SECURITY BARRIER FOR PROVIDING PROTECTION IN PUBLIC SPACE," which is a continuation of PCT/EP2019/058179, filed Apr. 1, 2019 and claims priority to EP 18165619.0, filed Apr. 4, 2018, the disclosures of which are hereby incorporated by reference in their entirety as if fully set forth herein.

FIELD OF THE DISCLOSURE

The present invention relates to a security barrier for providing protection in a public space and a method of manufacturing such security barrier.

BACKGROUND OF THE DISCLOSURE

Barriers of such kind may be provided as concrete blocks which are placed at entrances or the like to block vehicles from entering a public space around a potential terror target and thereby prevent vehicles being used for terror. Further security barriers or anti-terror safeguards may be provided in composite materials so that the barrier block may also provide ballistic protection. The barriers may be needed temporarily at sites for public events where large crowds are gathered and some security barriers are therefore designed for not only durability but also reusability. Examples of such security barriers are known from e.g. US 2009/0092443 A1, US 2008/0047418 and US 2010/0300275. Since such security barriers are generally large and are placed in the public space at generally visibly noticeable positions, it is also desired that the security barriers are provided with at least some degree of aesthetic appearance. From US 2004/0076468 an example of such type of security barrier is known.

SUMMARY OF THE DISCLOSURE

It is required for the security barrier to be heavy so that it is not easily moved and pushed aside by even a large vehicle, such as a truck. In order to provide adequate blockage it is also required that the security barriers have a relatively large size e.g. to absorb projectiles from firearms or fragments from explosives or the like. However, it is also desired that the security barriers can be moved from usage at a temporary site and then stored and reused again. This handling in order to recycle the security barriers for reuse, however, is difficult and cumbersome due to the size and the weight of the security barriers.

It is therefore an object by the present invention to provide a security barrier which is suitable for reuse and easier to handle during transport, storage and installation without compromising the anti-terror blockage effect which such security barrier is also required to provide.

This object is achieved by providing a security barrier for providing protection in a public space or the like, said barrier comprising a mineral wool assembly comprising at least one mineral wool element having an outer liquid impermeable covering and wherein the at least one mineral wool element is adapted for being filled with a liquid.

It is found advantageous that the security barrier according to the invention has a relatively low weight for transport and handling and then can be made heavy by filling the mineral wool element(s) with a liquid, preferably water. By using mineral wool fibre elements for the security barriers it is found advantageous since this material has very good ballistic dampening properties and experiments have shown that a projectile fired from a firearm can be stopped and only penetrate about 40 cm into the mineral wool material. Besides this ballistic dampening property, the mineral wool element fills the space inside the covering and thereby provides additional stability to the barrier, in particular preventing collapse of the space of the security barrier prior to filling.

The security barrier according to the invention is also found attractive from an aesthetic aspect. Since security barriers are used in public spaces it is found attractive that the security barriers according to the invention may be provided in different colours and with selected surface textures and even in different shapes, whereby a community council, an event organiser or the like can have the required security barriers custom made for the specific event.

In a particular aspect of the invention it is realised that a security barrier according to the invention may be provided in an indoor public space, such as for establishing security zones in an airport or a railway station.

The liquid impermeable covering may be in the form of a coating or a covering foil and/or laminate made of glass fibre webs or a carbon fibre webs. By applying a covering it is also advantageous that an individual security barrier may be both decorated and re-decorated, e.g. by (re-)spraying, according to its actual temporary use.

The mineral wool elements may have a pore volume of up to 97% and can therefore contain a relatively high amount of water, assuming the mineral wool has a binder weight fraction of 3.5%, binder density of 1346 kg/m$^3$ and fibre density of 2800 kg/m$^3$. Preferably the density of the mineral wool element in its dry state is 75-200 kg/m$^3$, preferably 75-150 kg/m$^3$, more preferably 90-120 kg/m$^3$. To further increase the water capacity of the element(s), the at least one mineral wool element may comprise a wetting agent.

In a preferred embodiment, a plurality of mineral wool elements are provided adjacent each other. This is advantageous since the security barrier can be made in a simple manner by providing a multiple of mineral wool elements adjacent each other in an assembly and then covering the assembly. To facilitate the handling during manufacture, the mineral wool elements are adhered to each other at discrete spots so the liquid can flow from one element to the other and the interior liquid volume inside the liquid impermeable covering is thus one common volume, whereby the filling of water into the security barrier is not compromised.

In this embodiment, the mineral wool elements form a common base surface of the mineral wool assembly with two opposite end surfaces substantially perpendicular to the base surface, and wherein the top surfaces of the mineral wool elements are at different distances from the base surface. In a preferred embodiment, the mineral wool elements can be made of mineral wool batts of 2000×600 mm with different heights whereby the length of the barrier will be 2 meters and with a dry weight of such barrier of up to 500 kg depending on the height of each of the elements.

In a preferred embodiment, the covering is a coating. Hereby the mineral wool assembly can be provided with a liquid impermeable cover in a simple manner. More preferably, the coating may be sprayed onto the surface, such as the entire surface, of the mineral wool assembly comprising the one or more mineral wool elements. This coating material is advantageous as it provides a liquid tight resilient seal around the surface of the mineral wool elements assembly. The coating material provides a rubber-like surface coating preferably of 3-5 mm in thickness whereby the coating is sufficiently strong to withstand the internal pressure of the liquid and also to provide a good protection against impacts on the exterior of the security barrier.

Moreover, said coating may be of a material selected from a group consisting of polystyrene (PS) foam, including expanded polystyrene (EPS) and extruded polystyrene foam (XPS), styrofoam, and polyurethane (PU) foam. Such polymeric foam coverings, such as spray foams are well suited for making an impermeable lightweight covering, which is easy and cheap to apply.

Alternatively, the covering of the mineral wool elements can be made of any liquid impermeable material, such as metal, polymers or the like in the form of a foil, a film, a glass or carbon fibre web or laminates thereof. Depending on the choice of covering material, this can be applied by shaping, dipping (immersing) or spraying onto the surface of the mineral wool element.

Accordingly, in an embodiment, the liquid impermeable covering may be a covering foil and/or fibre web laminate, such as glass fibre laminate or a carbon fibre laminate, said laminate preferably having 2-8 layers, more preferably 4-6 layers, more preferably 5 layers. It may be advantageous to use a fibre reinforced laminate, such as a glass fibre laminate with a multiple of layers as such laminate covering may provide good ballistic dampening and impact resistant properties to the covering. Glass fibre webs may be applied to the surface of the mineral wool elements by roller or the like where the web is wetted with resin which impregnates the fibres and bonds to the mineral wool elements as well.

In a particular embodiment, the outermost layer of the laminate may be a covering foil. This outer foil of the liquid impermeable covering may be provided with a predetermined colour scheme, such as printings of logos or the like. Hereby, the security barrier can be provided with an appearance with is adapted to the present environment in which the security barrier is applied. Accordingly, the security barriers according to the invention may be dressed as advertisements both by the colour scheme, logo prints as well as the shape in which the security barrier is provided.

In preferred embodiments, the foil or laminate is adhered to the mineral wool element(s) by an adhesive, such as a liquid adhesive or a powder adhesive, which is insolvable by the liquid to be filled into the security barrier. Preferably, the adhesive is water insolvable.

In the embodiments where the liquid impermeable covering is provided by multi-layered glass or carbon fibre webs, it may be advantageous that the laminate is adhered to the mineral wool element(s) by the resin of the fibre reinforced laminate. By the invention, it is realised that although specific references to glass fibre laminate or a carbon fibre laminates are made, any other material of fibre reinforcement may be used.

Preferably, an opening for liquid filling is provided in the covering, such as in the upper portion of the mineral wool assembly, for instance in the top surface thereof. Hereby a filling opening is provided so that the security barrier can be filled with water through this opening. Preferably, there is then provided a cover, such as a lid, covering the top surface at the highest distance from the base surface. There is preferably also provided a liquid filling cover covering the opening, for instance at the top surface at the highest distance from the base surface in order to prevent the liquid from evaporating.

In an embodiment of the security barrier according to the invention, a metal sheet cover is provided on one or more of the sides of the barrier. Hereby, an extra impact protection can be provided.

In order to monitor the security barrier when in use, it is found advantageous to provide a moisture detection sensor in the mineral wool assembly, preferably in the upper half thereof. Hereby, any leaks in the coating of evaporation of water through the top surface can be detected.

To facilitate removal of the security barrier, it is found useful to provide a drainage arrangement, such as a hole and a plug, in the covering, preferably in the vicinity of the base surface. Hereby, the security barrier can be drained of liquid for easier removal as the weight thereby is decreased. The draining can be performed in a simple manner by removing a plug, drilling a hole in the covering or the like.

According to another aspect of the invention there is provided a method of manufacturing a security barrier according to any of the preceding claims, said method comprising the steps of providing a mineral wool assembly comprising at least one mineral wool element, and mounting an outer liquid impermeable covering around the mineral wool assembly.

Hereby, the security barrier can be manufactured off-site and stored in a "dry-weight" state where it is easier to handle. It is then a simple operation to transport one or more security barriers to a site and then fill them up once the barrier or barriers are provided on the predetermined location.

Preferably, the method of manufacturing also involves the step of mounting an outer liquid impermeable covering in the form of spray coating of the outer surface of the mineral wool assembly.

In order to achieve a desired shape of the security barrier, the method preferably also involves providing a plurality of mineral wool elements adjacent each other and adhering them to each other to form the mineral wool assembly, and whereby the mineral wool elements are secured to each other in discrete spots prior to the covering. This facilitates the handling of the mineral wool assembly during manufacture, and as the mineral wool elements are adhered to each other at discrete spots the liquid can flow from one element to the other since the interior liquid volume inside the liquid impermeable covering is thus one common volume. This ensures that the filling of water into the security barrier is not compromised.

In a further aspect of the invention, a method of preparing a security barrier for providing protection in a public space is provided, wherein the method comprises the steps of positioning the security barrier manufactured by a method as explained above, and then filling the security barrier with a liquid, preferably water.

As explained above, this provides for a larger security barrier, which is nevertheless relatively easy to store and to move from a storage to a temporary position in the public space.

BRIEF DESCRIPTION

In the following the invention is disclosed in more detail with reference to the accompanying drawings, in which.

DETAILED DESCRIPTION OF THE DISCLOSURE

Figure 1:
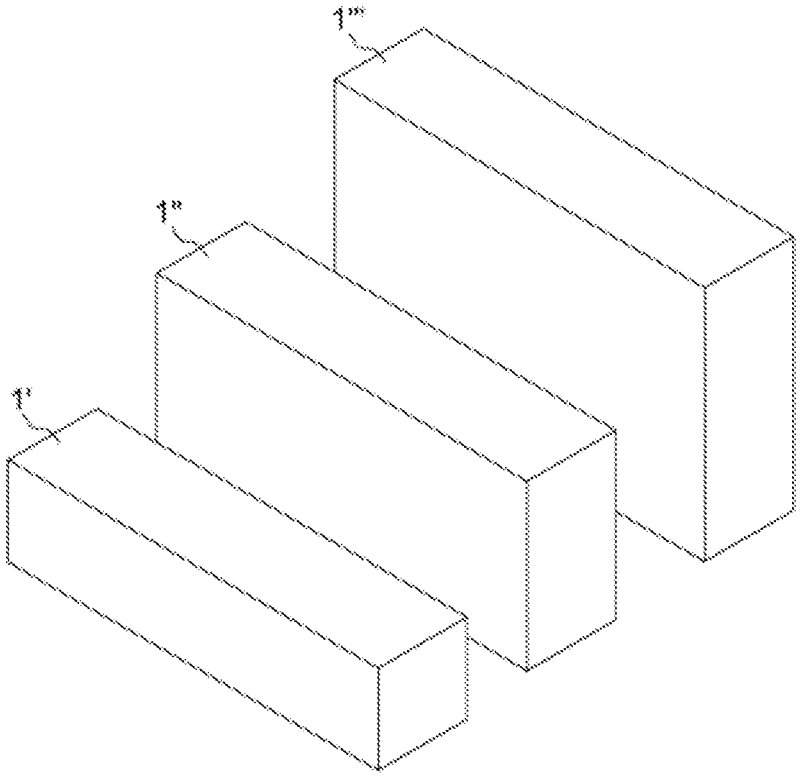
FIGS. 1 to 5 show steps in the manufacture of a security barrier according to an embodiment of the invention.

With reference to the FIGS. 1 to 5, a security barrier 1 according to one embodiment of the invention is shown. In this embodiment, the security barrier 1 comprises three mineral wool elements 1', 1", 1'". As shown in the figures these three mineral wool elements have different heights and are placed adjacent each other and preferably adhered to each other at discrete spots (not shown) to form a mineral wool elements assembly.

Since the mineral wool elements are adhered to each other at discrete spots a liquid, preferably water, can flow from one mineral wool element 1', 1", 1'" to the other and the interior liquid volume inside a coating 5 applied to the exterior surface of the mineral wool assembly 1. Thus, there is formed one common volume, which can be filled with to make the security barrier heavy and thereby very difficult to move.

The mineral wool elements 1', 1", 1'" preferably form a common base surface (not visible in the figures) and end surfaces 2 at opposite side of the base surface but form individual top surfaces 10 at different distances from the base surface.

As shown in the figures the security barrier is given a stepwise increasing shape by providing the mineral wool elements 1', 1", 1'" in different heights. The mineral wool elements 1', 1", 1'" may have a pore volume of at least 95% and can therefore contain a relatively high amount of water. The mineral wool may have a binder weight fraction of 3.5%, binder density of 1346 kg/m$^3$ and fibre density of 2800 kg/m$^3$. The density of the mineral wool elements 1', 1", 1'" in its dry state is 75-200 kg/m$^3$, preferably 75-150 kg/m$^3$, more preferably 90-120 kg/m$^3$. To further increase the water capacity of the elements, the mineral wool elements 1', 1", 1'" are preferably hydrophilic.

Mineral Wool Fibres

The mineral wool elements for the security barrier are made of man-made vitreous fibres (MMVF) which can be glass fibres, ceramic fibres, basalt fibres, slag wool, stone wool and others, but are usually stone wool fibres, bonded with a binder. Stone wool generally has a content of iron oxide at least 3% by weight and content of alkali earth metals such as calcium oxide and magnesium oxide from 10 to 40% by weight along with the other usual oxide constituents of MMVF. These are silica; alumina; alkali metals such as sodium oxide and potassium oxide which are usually present in low amounts; and can also include titania and other minor oxides. Fibre diameter is often in the range of 2 to 10 μm, preferably 3 to 5 μm. The MMVF material is in the form of a coherent mass. That is, the MMVF material is generally a coherent matrix of MMVF, which has been produced as such and formed into mineral wool elements for the security barrier.

Hydrophilicity

Normally the MMVF material for mineral wool insulation contain oil for making the products hydrophobic and prevent them from absorbing moisture. The MMVF material for the security barrier elements is however, manufactured without adding of oil to make the elements less hydrophobic, and may even be hydrophilic that it attracts water, provided water is used to fill the security barrier. The MMVF material for the elements can be hydrophilic due to the binder system used, the binder itself may be hydrophilic and/or a wetting agent is used.

The hydrophilicity of a sample of MMVF can be measured by determining the sinking time of a sample. A sample of MMVF material having dimensions of 100×100×65 mm is required for determining the sinking time. A container with a minimum size of 200×200×200 mm is filled with water. The sinking time is the time from when the sample first contacts the water surface to the time when the test specimen is completely submerged. The sample is placed in contact with the water in such a way that a cross-section of 100×100 mm first touches the water. The sample will then need to sink a distance of just over 65 mm in order to be completely submerged. The faster the sample sinks, the more hydrophilic the sample is. The MMVF material is considered hydrophilic if the sinking time is less than 120 seconds. Preferably, the sinking time is less than 60 s. In practice, the MMVF material may have a sinking time of a few seconds, such as less than 10 seconds.

When the binder is hydrophobic, a wetting agent is additionally included in the MMVF material in order to ensure that the material is hydrophilic. A wetting agent will increase the amount of water that the MMVF material can absorb. The use of a wetting agent in combination with a hydrophobic binder results in a hydrophilic MMVF material.

The wetting agent used may be any of the wetting agents known for use in MMVF material that are used for as growth substrates. For instance, it may be a non-ionic wetting agent such as Triton X-100 or Rewopal. Other wetting agents may be used, for instance anionic wetting agents such as linear alkyl benzene sulphonate or sodium lauryl ether sulphate (also called SLES). An example of an anionic SLES is Disponil FES27A supplied by BASF.

The binder of the MMVF material can be hydrophilic. The hydrophilic binder does not require the use of a wetting agent. A wetting agent can nevertheless be used to increase the hydrophilicity of a hydrophilic binder in a similar manner to its action in combination with a hydrophobic binder. This means that the MMVF material will absorb a higher volume of water than if the wetting agent is not present. Any hydrophilic binder known per se can be used.

Binder

The binder may be any binders known for use as binders for coherent MMVF products.

The binder may be an aldehyde based resin such as phenol formaldehyde resin (PF), phenol urea formaldehyde resin (PUF), urea formaldehyde resin (UF), melamine formaldehyde resin (MF), melamine urea formaldehyde resin (MUF), melamine phenol formaldehyde resin (MPF), and melamine urea phenol formaldehyde resin (MUPF). This type of binder can be economically produced for use as a binder in many applications including security barrier elements.

The binder may be a formaldehyde-free aqueous binder composition comprising: a binder component (A) obtainable by reacting at least one alkanolamine with at least one carboxylic anhydride and, optionally, treating the reaction product with a base; and a binder component (B) which comprises at least one carbohydrate, as disclosed in WO2004/007615. Binders of this type are hydrophilic.

Further formaldehyde-free binder compositions such as those comprising:

a) a sugar component, and b) a reaction product of a polycarboxylic acid component and an alkanolamine component, wherein the binder composition prior to curing contains at least 42% by weight of the sugar component based on the total weight (Dry matter) of the binder components may be used in the present invention, preferably in combination with a wetting agent. The binder may be a furan binder, as disclosed in WO97/07664, which lends its hydrophilic properties to the material. The use of furan resin allows for not adding a wetting agent. Binders of this type may be used in the present invention.

The mineral wool elements are made by melting the raw materials in large cupola furnaces at a temperature of about 1500° C. The melt is directed onto a series of fast rotating wheels spinning (if stone wool) and formed into rock fibres with an average diameter of about 2 to 10 microns. A binding agent is added and, for hydrophilic products, an additional wetting agent can be introduced (see above). The wool is then cured in special curing ovens. Between the interconnected fibres a constant void volume is maintained, which void volume will be filled with the liquid when the security barrier is in use.

Figure 3:
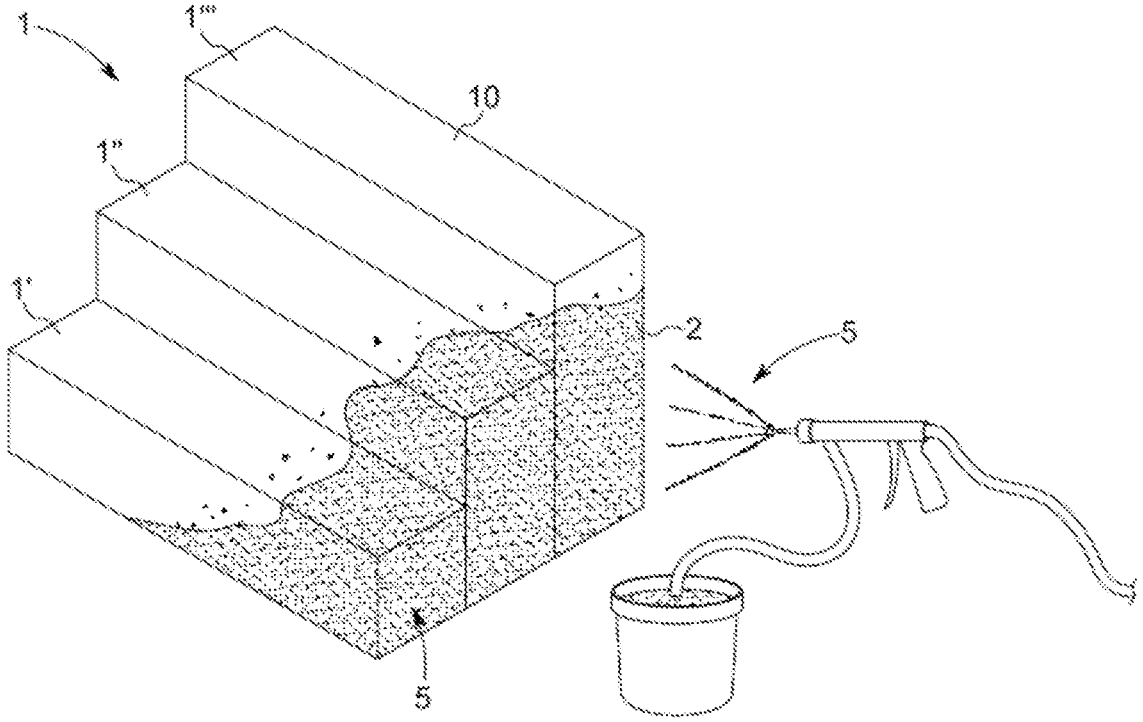

Light mineral wool consisting of air in an amount of 99% by weight and bound fibres in an amount of 1% by weight. It follows that the heavier the product (higher density) the lower the amount of voids. The quantity of fibres in heavier mineral wool materials may be as high as 6%. With a density of 100 kg/m$^3$, the mineral wool fibre products contain approx. 95-97% voids, where the mineral wool may have a binder weight fraction of approx. 3.5%, binder density of approx. 1346 kg/m$^3$ and fibre density of approx. 2800 kg/m$^3$ As shown in FIG. 3, a covering such as a coating 5 is applied, preferably by spraying.

The covering of the mineral wool elements can be made of any liquid impermeable material such as metal, polymers or the like. Depending on the choice of covering material, this can be applied by shaping, dipping (immersing) or spraying onto the surface of the mineral wool element.

Polymer materials can be in the form of a foil, a film or a liquid coating. Especially polymeric foam coverings, such as spray foams are well suited for making an impermeable lightweight covering, which is easy and cheap to apply. By the term "spray foam" is understood a chemical product created by two materials, isocyanate and polyol resin, which react when mixed with each other and expand up to 30-60 times its liquid volume after it is sprayed in place. This expansion makes it useful as a coating material which forms to the shape of the product being coated and produces a liquid impermeable coating with high thermal insulating value and virtually no air infiltration.

Preferred spray foams may include:

polystyrene (PS) foam, including expanded polystyrene (EPS) and extruded polystyrene foam (XPS), styrofoam, or polyurethane (PU) foam.

Examples of polyurethane spray foams are S-35RGB/ECO polyurethane spray from Synthesia Internacional s.l.u. or the two-component watertight membrane named MasterSeal M 689 from BASF.

Any openings arising in a covering made of a rigid material, i.e. metal, foil or film coverings, which openings are originating from the fitting or adapting of the cover to the mineral wool elements, can be made impermeable (moisture or liquid tight) by welding or gluing or by (re-)spraying of the polymeric foam.

As shown in FIG. 3, the coating material may be sprayed onto the entire surface of the mineral wool assembly 1 except the top surface 10 at the highest distance from the base surface. This coating material is advantageous as it provides a liquid tight resilient seal around the surface of the mineral wool elements assembly 1. The coating material provides a rubber-like surface coating preferably of 3-5 mm in thickness so that the coating, which is an impermeable covering 5 is sufficiently strong to withstand the internal pressure of the liquid and also to provide a good protection against impacts on the exterior of the security barrier.

Figure 4:
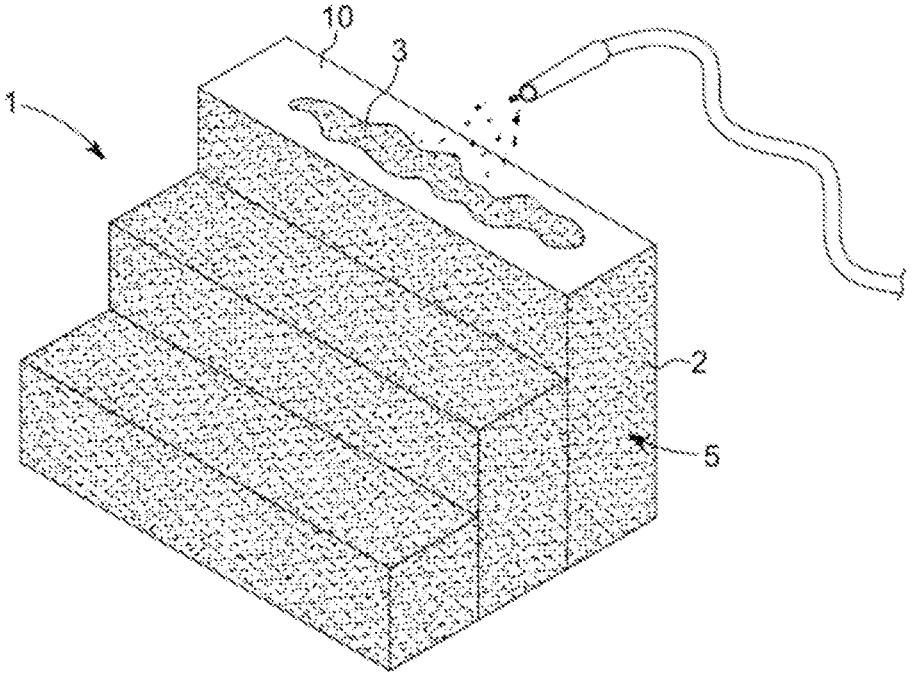
Figure 5:
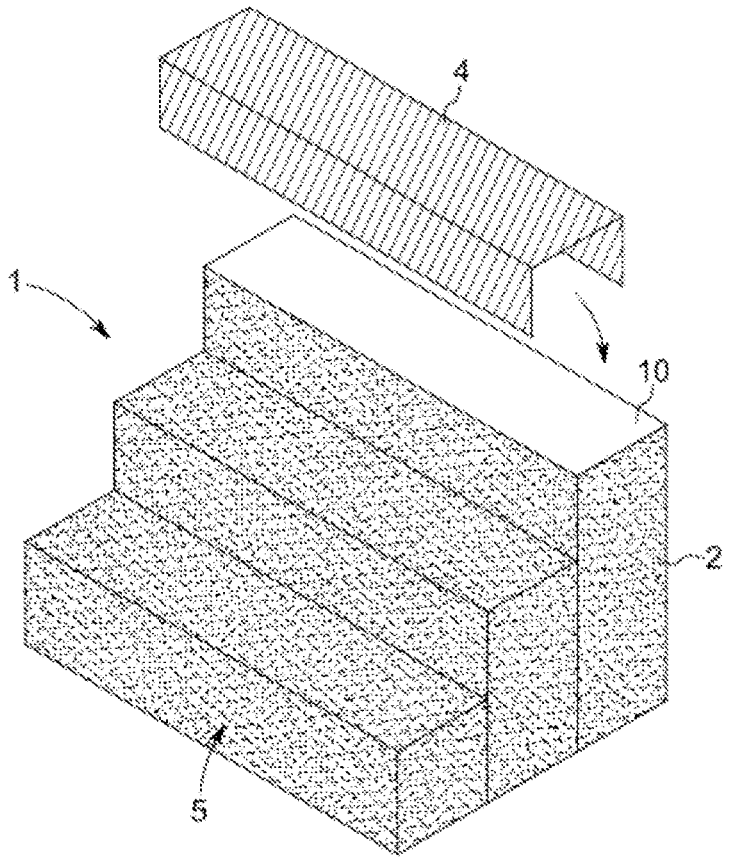

As can be seen in FIG. 4, the top surface 10 of the mineral wool element 1''' is left open so that the security barrier can be filled with water through this opening 3. Preferably, as shown in FIG. 5, there is then provided a cover 4 covering the top surface 10 at the highest distance from the base surface.

Figure 6:
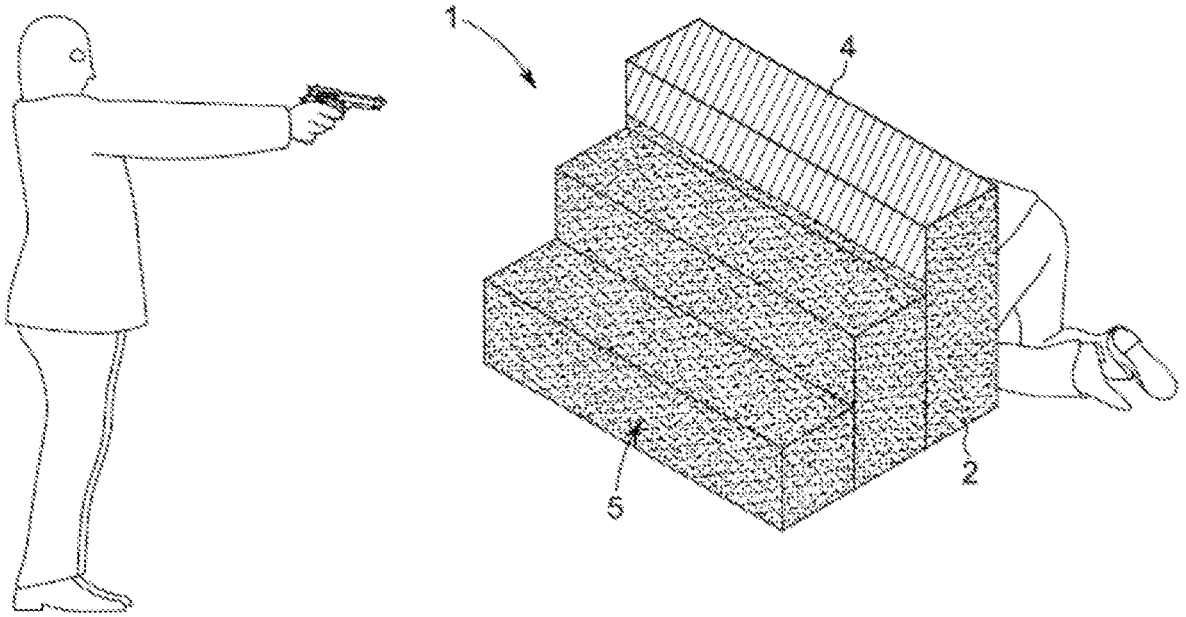
FIG. 6 shows a schematic view of a security barrier according to an embodiment of the invention.

In FIG. 6, the finished security barrier is shown. In this configuration with a security barrier in the dimensions as indicated in the example below, it is found virtually impossible to move the security barrier by a vehicle. Furthermore with a surface coating of 3-5 mm. the rubber-like coating and the mineral wool elements provide a good impact resistance and it has been found that the energy absorption capability is very good to stop projectiles and thus provides a very good barrier block and ballistic protection.

Figure 7:
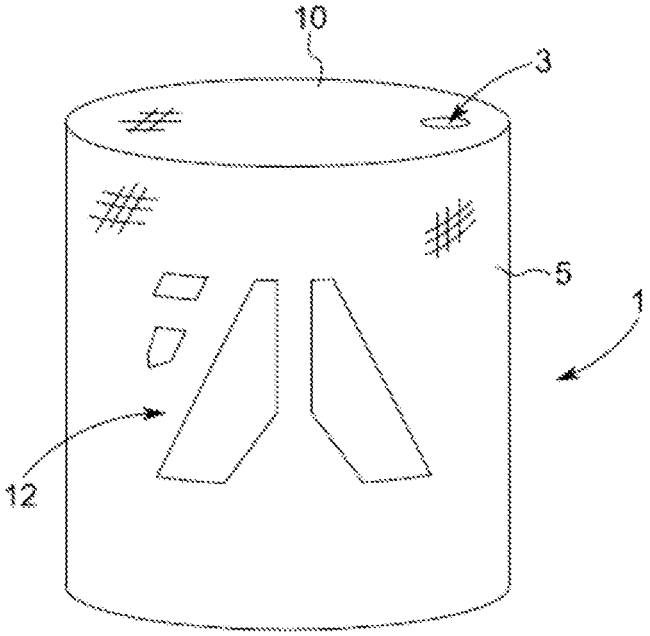
FIG. 7 shows a schematic a security barrier according to another embodiment of the invention with an individualised shape.

FIG. 7 shows another embodiment, where the security barrier 1 is provided with an individualised shape, in the example shown a cylinder form. The security barrier comprises a mineral wool element (not visible in the figure) which is provided with a liquid impermeable covering 5, which is preferably a multi-layered laminate of glass fibres, such as chopped strand webs of glass fibres, which is provided on the exterior surfaces of the mineral wool element and wetted and impregnated with a resin and then left to cure. The top surface 10 is also covered by the laminate and with opening 3 for the filling of water into the interior of the security barrier. Several layers of glass fibre webs are provided to provide the security barrier with a resilient and impact resistant covering. An example the laminate has five layers and a thickness of 6 mm. The outermost layer is a foil 12 with printed features, such as a logo or the like.

Figure 2:
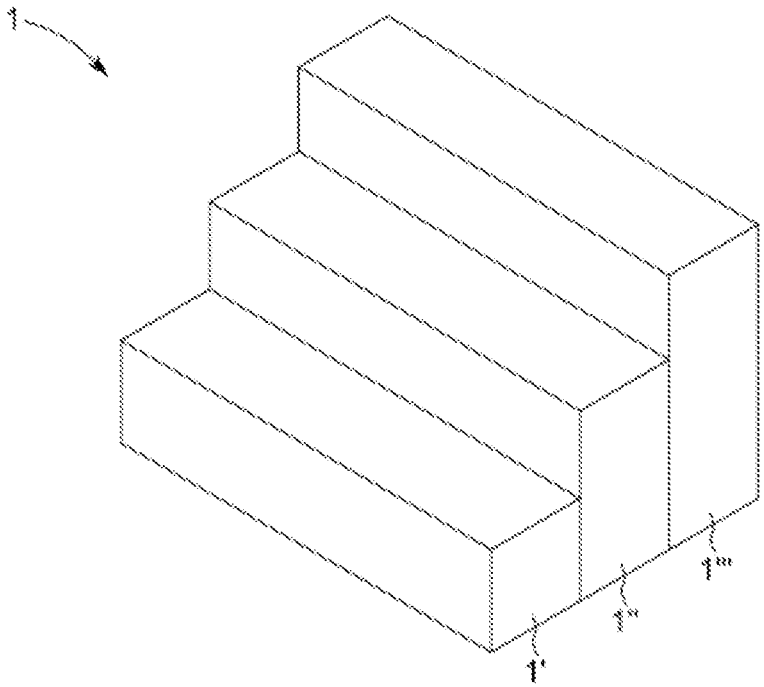

As indicated by the FIGS. 2 and 7, the mineral wool elements 1 may be assembled to any suitable form in order to meet any aesthetic and/or commercial requests for the public space in which the security barrier is to be utilised.

EXAMPLE

In an example, the mineral wool assembly is made of three mineral wool elements forming a step-like configuration. The dimensions are:

First element (ref. No. 1' in FIGS. 1-3): 600×600×2000 mm

Second element (ref. No. 1" in FIGS. 1-3): 600×900×2000 mm

Third element (ref. No. 1''' in FIGS. 1-3): 600×1200×2000 mm

The volumes of each of the three mineral wool elements are 0.72 m$^3$, 1.08 m$^3$ and 1.44 m$^3$, respectively. This gives a total volume of 3.24 m$^3$.

The mineral wool elements are made with a density of 100 kg/m$^3$. Mineral wool fibre products contain an amount of voids. With this density the mineral wool is approx. 95-97% voids. With the volume calculated above, the overall weight of the mineral wool assembly is thus 324 kg.

The overall surface area is 15.24 m$^2$. The mineral wool assembly is spray coated with a liquid polymer to provide watertight membrane. In an example a two-component polyurethane spray foam MasterSeal M 689 from BASF is used.

The density of such polymer spray coating is typically 1.1 g/cm$^3$. With a coating of 5 mm applied the weight of the coating is approx. 84 kg.

This means that the total dry weight of the security barrier is approx. 408 kg.

With a total volume of the mineral wool elements of 3.24 m$^3$ and with a mineral wool having at least 95% voids, this means that the mineral wool assembly of the security barrier of the example is capable of absorbing up to 3,078 litres of water.

This means that when installed on site the security barrier having a footprint on the ground of merely 3.6 m$^2$ has a total weight of up to 3,486 kg, which is approx. 8.5 times the weight in its dry state.

The invention claimed is:

1. A security barrier for providing protection in a public space or the like, said barrier comprising a mineral wool assembly comprising at least one mineral wool element having an outer liquid impermeable covering and wherein the at least one mineral wool element is adapted for being filled with a liquid.

2. A security barrier according to claim 1, wherein the security barrier is filled with a liquid, said liquid including water.

3. A security barrier according to claim 1, wherein the density of the at least one mineral wool element in its dry state is 75-200 kg/m$^3$.

4. A security barrier for providing protection in a public space or the like, said barrier comprising a mineral wool assembly comprising at least one mineral wool element having an outer liquid impermeable covering and wherein the at least one mineral wool element is adapted for being filled with a liquid, wherein the at least one mineral wool element comprises man-made vitresous fibers and a wetting agent.

5. A security barrier according to claim 1, wherein a plurality of mineral wool elements are provided adjacent each other.

6. A security barrier according to claim 5, wherein the mineral wool elements form a common base surface of the mineral wool assembly with two opposite end surfaces substantially perpendicular to the base surface, and wherein top surfaces of the mineral wool elements are at different distances from the base surface.

7. A security barrier for providing protection in a public space or the like, said barrier comprising a mineral wool assembly comprising at least one mineral wool element having an outer liquid impermeable covering and wherein the at least one mineral wool element is adapted for being filled with a liquid, wherein the covering is a coating.

8. A security barrier according to claim 1, wherein the liquid impermeable covering is a covering foil and/or fibre laminate, such as glass fibre laminate or a carbon fibre laminate.

9. A security barrier according to claim 8, wherein the outermost layer of the laminate is a covering foil.

10. A security barrier according to claim 8, wherein the foil or fibre laminate is adhered to the mineral wool element(s) by an adhesive, such as a liquid adhesive or a powder adhesive, which is insolvable by the liquid to be filled into the security barrier.

11. A security barrier according to claim 8, wherein the fibre laminate is adhered to the mineral wool element(s) by resin of the fibre laminate.

12. A security barrier according to claim 1, wherein the liquid impermeable covering is provided with a predetermined colour scheme, such as printings of logos or the like.

13. A security barrier according to claim 1, wherein an opening for liquid filling is provided in the liquid impermeable covering, such as in the upper portion of the mineral wool assembly, for instance in the top surface thereof.

14. A security barrier according to claim 13, wherein there is provided a liquid filling cover covering the opening.

15. A security barrier according to claim 1, wherein a metal sheet cover is provided on one or more of the sides of the barrier.

16. A security barrier according to claim 1, wherein a moisture detection sensor is provided in the mineral wool assembly.

17. A method of manufacturing a security barrier according to claim 1, said method comprising the steps of:

providing a mineral wool assembly comprising at least one mineral wool element, and mounting an outer liquid impermeable covering around the mineral wool assembly.

18. A method according to any claim 17, whereby the step of mounting an outer liquid impermeable covering involves spray coating of the outer surface of the mineral wool assembly.

19. A method according to claim 17, whereby a plurality of mineral wool elements are provided adjacent each other and adhered to each other to form the mineral wool assembly, and whereby the mineral wool elements are secured to each other in discrete spots prior to the coating.

20. A method of preparing a security barrier for providing protection in a public space, wherein the method comprises the steps of:

positioning the security barrier manufactured by a method according to claim 17, and then filling the security barrier with a liquid.

21. A security barrier according to claim 1, wherein the at least one mineral wool element includes mineral wool fibre products dispersed throughout an entire volume of the at least one mineral wool element.

22. A security barrier according to claim 1, wherein the at least one mineral wool element includes at least 95% voids and is capable of absorbing water.

23. A security barrier according to claim 8, wherein the laminate includes 2 to 8 layers.

* * * * *